313-422 SR
7/1/86 OR 4,598,227

United States Patent [19]
Credelle

[11] Patent Number: 4,598,227
[45] Date of Patent: Jul. 1, 1986

[54] ELECTRON BEAM CONVERGENCE AND SCANNING STRUCTURES FOR FLAT PANEL DISPLAY DEVICE

[75] Inventor: Thomas L. Credelle, Mercer County, N.J.

[73] Assignee: RCA Corporation, Princeton, N.J.

[21] Appl. No.: 593,093

[22] Filed: Mar. 26, 1984

[51] Int. Cl.[4] ..... H01J 29/08; H01J 29/74
[52] U.S. Cl. ..... 313/422
[58] Field of Search ..... 313/422, 428, 456, 412, 313/413, 414, 449

[56] References Cited

U.S. PATENT DOCUMENTS 4,117,368 9/1978 Marlowe et al. ..... 313/422
4,131,823 12/1978 Credelle ..... 313/422
4,330,735 5/1982 Leedom ..... 313/422

*Primary Examiner*—David K. Moore
*Assistant Examiner*—K. Wieder
*Attorney, Agent, or Firm*—E. M. Whitacre; D. H. Irlbeck; L. L. Hallacher

[57] ABSTRACT

A structure for converging electrons at the screen of a flat panel display and for transversely scanning electrons across the channels of the display includes a plurality of conductive strips arranged between the acceleration mesh and the phosphor screen. The strips extend longitudinally along and are substantially parallel to the acceleration mesh and are also substantially parallel to one another. A first portion of the strips is voltage biased to converge electrons in the proximity of the screen and scan said electrons transversely across the channels and the other portion is voltage biased to scan the electrons transversely across the channels.

4 Claims, 2 Drawing Figures

ELECTRON BEAM CONVERGENCE AND SCANNING STRUCTURES FOR FLAT PANEL DISPLAY DEVICE

BACKGROUND OF THE INVENTION

This invention relates generally to flat panel display devices and particularly to an electron beam convergence and scanning structure for such devices.

Prior art flat panel display devices include a baseplate and a faceplate which are held in a spaced parallel relationship by a plurality of external sidewalls. A phosphor screen is arranged on the inside surface of the faceplate to produce a desired image when struck by electrons. The envelope is divided into a plurality of channels by internal support walls which also provide support against collapse because of atmospheric pressure. Each of the channels includes a beam guide structure along which electron beams propagate the lengths of the channels until one line of the visual display is to be produced. The electron beams are simultaneously ejected from propagation along between the guide mesh structures in all channels and travel toward the screen. When a color display is to be produced, each of the channels includes three electron beams which are individually modulated with the red, green and blue video information. As electrons travel toward the screen, they are converged to meet at a shadow mask which is spaced a preselected distance from the screen. The electron beams also are scanned transversely across each of the channels so that each channel produces a particular portion of the total horizontal line. U.S. Pat. No. 4,131,823 to T. L. Credelle discloses an electron beam convergence structure in which convergence electrodes are placed on the sides of the internal support walls. U.S. Pat. No. 4,117,368 to F. J. Marlowe et al. discloses a structure for transversely scanning the electron beams across the channels in which deflection electrodes are placed on the inside surfaces of the internal support walls. U.S. Pat. No. 4,330,735 to M. A. Leedom discloses a beam guide structure for a flat panel display device in which the meshes of the beam guide assemblies are held in the desired spaced parallel relationship by a plurality of insulative beads.

The convergence structure described in the Credelle patent and the beam scanning structure disclosed in the Marlowe et al. patent both are satisfactory for the purposes intended, however, in both of these systems the convergence and scanning electrodes are placed onto the internal support walls. Accordingly, because the convergence and scanning electrodes extend the full length of the channels, the glass from which the support walls are made must be flat to very close tolerances to assure uniform convergence and deflection along the full channel length. Additionally, the electron beams travel parabolic trajectories between the beam guide and the screen. As known to those skilled in the art, this results in a short distance between the deflection center and the screen. This leads to a larger spot on the screen which can cause color impurities. Also fringe fields from the scanning electrodes can affect color purity at the boundaries of the channels. The fringe fields can also cause color convergence errors in the longitudinal and transverse directions.

The present invention overcomes these difficulties by the provision of an electron beam convergence and scanning structure which is separate from the internal support walls and which provides localized scanning in the proximity of the beam guides.

SUMMARY

A structure for converging electrons at the screen of a flat panel display and for transversely scanning electrons across the channels of the display includes a plurality of conductive strips arranged between the acceleration mesh and the phosphor screen. The strips extend longitudinally along and are substantially parallel to the acceleration mesh and are also substantially parallel to one another. A portion of the strips is voltage biased to converge electrons in the proximity of the screen and all of the strips are voltage biased to scan the electrons transversely across the channels.

DETAILED DESCRIPTION

Figure 1:
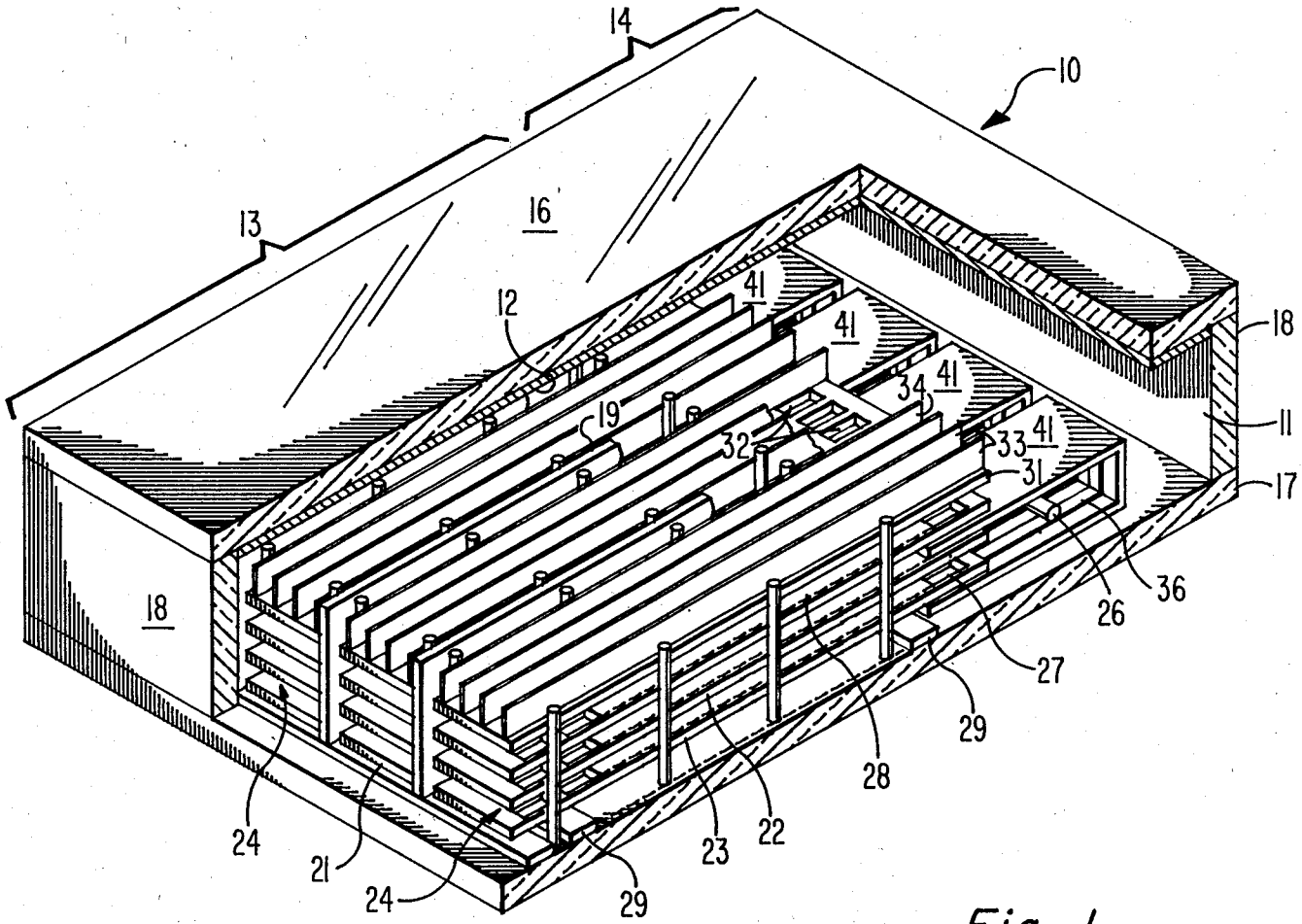
FIG. 1 is an isometric view, partially broken away, of a flat panel display device incorporating the preferred embodiment.

FIG. 1 shows a flat panel display device 10 incorporating the preferred embodiment. The display device 10 includes an evacuated envelope 11 having a display section 13 and an electron gun section 14. The envelope 11 includes a frontwall 16 and a baseplate 17 held in a spaced parallel relationship by sidewalls 18. A display screen 12 is positioned along the frontwall 16 and gives a visual output when struck by electrons.

A plurality of spaced parallel support vanes 19 are arranged between the frontwall 16 and the baseplate 17. The support vanes 19 provide the desired internal support against external atmospheric pressure and divide the envelope 11 into a plurality of channels 21. Each of the channels 21 encloses a pair of spaced parallel beam guide meshes 22 and 23 extending transversely, or horizontally, across the channels and longitudinally, or vertically, along the channels from the gun section 14 to the opposite sidewall 18. A cathode 26 is arranged to emit electrons into the spaces 24 between the guide mesh pairs of each channel. An individual cathode can be used for each electron beam of the device, a number of cathodes can be used to provide the electrons needed for several beams, or a single line cathode can be used to produce the electrons for all the beams. The guide meshes 22 and 23 include apertures 27 which are arranged in columns longitudinally along the channels 21 and in rows transversely across the channels when three electron beams are used for a color display. A focus mesh 28 is spaced above the upper guide mesh 22 in a parallel relationship therewith. A plurality of extraction electrodes 29 are arranged along the baseplate 17 to extend transversely across the channels 21 the full width of the display device 10. The extraction electrodes 29 are arranged directly beneath the rows of apertures 27 in the guide meshes 22 and 23. Appropriate biasing voltages are applied to the focus mesh 28 and the extraction electrodes 29 to cause the electrons emitted from the cathode 26 to propagate between the guide meshes 22 and 23 in the spaces 24 for the full length of the channels.

An acceleration mesh 31 is arranged in a spaced parallel relation with the focus mesh 28 and contains a plurality of apertures 32 which also are arranged in columns longitudinally of the channels and in rows transversely of the channels. Electron beam convergence electrodes 34 and scanning electrodes 33 are arranged between the acceleration mesh 31 and the screen 12 Modulation electrodes 36 and isolation electrodes 41 overlap the cathode 26.

In operation, the cathode 26 emits electrons into the spaces 24 between the meshes 22 and 23. Modulation voltages are applied to the modulation electrodes 36 to cause the electron beams to produce the desired display on the screen 12. The isolation electrodes 41 are biased more negatively than the cathode 26 to prevent electron emission between the columns of apertures 27. Additionally, the isolation electrodes prevent the different modulation voltages on adjacent modulaton electrodes 36 from interacting. The electron beams propagate in the spaces 24 between the guide meshes 22 and 23 until the production of one horizontal line of the visual display requires the beams to be directed toward the screen 12. Extraction of the electron beams from the spaces between the guide meshes is effected by applying a negative voltage to one of the extraction electrodes 29. The negative voltage causes the electron beams to pass through the apertures 27 in the guide meshes and the apertures 32 in the focus mesh 28 and the acceleration mesh 31. The extracted electron beams are converged prior to reaching the screen 12 by applying a voltage which is negative (less positive) with respect to the voltage on the inner electrodes 33 to the outer electrodes 34. The extracted electron beams are horizontally scanned across the channels 21 by the application of varying voltages, such as sawtooth waveforms, to the inner electrodes 33 and the outer electrodes 34. Every channel therefore is horizontally scanned between the two support vanes 19 so that each channel contributes a portion of each horizontal line of the visual display on the faceplate 16.

Figure 2:
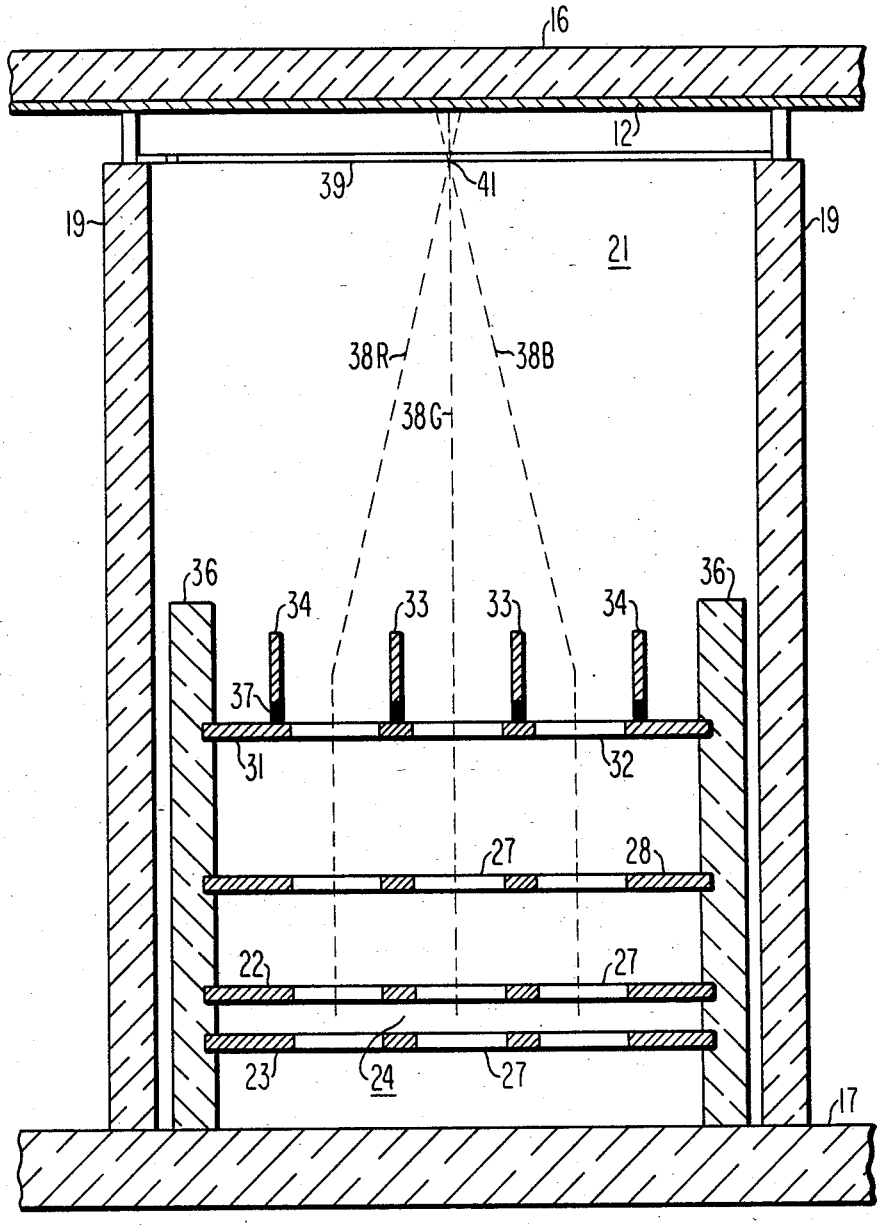
FIG. 2 is a cross-section view of a preferred embodiment.

In FIG. 2, the beam guide meshes 22, 23 the focus mesh 28 and the acceleration mesh 31 are held in a spaced parallel relationship by a plurality of insulative support beads 36 in a manner fully described in U.S. Pat. No. 4,330,735. The outer electrodes 34 and the inner electrodes 33 are arranged between the acceleration mesh 31 and the screen 12. Also, the electrodes 33 and 34 are arranged between the longitudinal columns of apertures 32 so that the electrodes do not interfere with the electron beams passing through the apertures when travelling toward the screen 12. The electrodes 33 and 34 are made of a conductive material which has a coefficient of expansion substantially equal to that of the acceleration mesh 31. Electrodes 33 and 34 can be affixed to the mesh 31 using an insulative material 37 to electrically separate the electrodes from the acceleration mesh 31. Such materials are commercially available and for example the material used in the production of focus masks for kinescopes can be used. Alternatively, a mechanical support structure can be used to support both ends of each of the electrodes 33 and 34 to maintain the electrodes at a spaced parallel relationship with respect to the acceleration mesh 31. The electrodes 33 and 34 are arranged with the planes of the electrodes substantially perpendicular to the plane of the acceleration mesh 31 to assure that the electron beams passing through the apertures 32 are equally influenced by the voltages on the electrodes.

In operation, the electron beams propagate in the space 24 between meshes 22 and 23 along the columns of apertures formed in the meshes. Upon ejection from propagation in the space 24, the beams travel toward the screen 12 and pass through the apertures 27 in the focus mesh 28 and the apertures 32 in the acceleration mesh 31. The electrodes 34 are set at a voltage which is negative with respect to the voltage on the electrodes 33. Accordingly, the outer beams 38R and 38B are deflected inwardly toward the middle beam 38G. The voltage differential is selected so that the beams converge at a convergence point 41 on an apertured shadow mask 39. The beams pass through the mask apertures and strike the proper color phosphors on the screen 12 to produce the desired color display. The electrodes 33 and 34 are biased with a scanning waveform such as a triangular waveform, to cause the point 41 at which the beams converge to be scanned transversely across the full width of the channels 21.

Examples of dimensions and operating voltages which can be used are:

1.

Approximately 1.04" wide by 4" high channels measured from baseplate 17 to screen 12.

Electrodes 33 and 34 0.040" thick×0.300" high on 0.200" centers $V_{convergence}=9{,}500\pm635$ V on electrodes 34

$Q_{spacing}=316$ mils from shadow mask 39 to screen 12 for color separation of 21 mils $V_{deflect}=10{,}000\pm635$ V on scan electrodes to scan corners Color misconvergence<4 mils Penumbra tail improvement~2X reduction over prior art scanning structure Trio separation error<0.2 mil

2.

Approximately 1.25" wide by 3.2" high channels, measured from baseplate 17 to screen 12

Electrodes 33 and 34 0.040" thick×0.300" high on 0.200" centers $V_{convergence}=10{,}000\pm1000$ V on convergence electrodes 34

$Q_{spacing}=234$ mils from shadow mask 39 to screen 12 for color separation of 21 mils $V_{deflect}=10{,}000\pm1000$ V on scan electrodes to scan corners Color misconvergence<9 mils Penumbra tail improvement~2X reduction Trio separation error<0.5 mil Drift region distance reduced by 30%

In addition to the elimination of the electrodes on the support walls 29, several important advantages are obtained from the inventive structure. The scanning electrodes are separate for each electron beam and the scanning is localized near the acceleration mesh 31. Also the electron beam trajectories in the drift region between the acceleration mesh 31 and the shadow mask 39 are substantially straight lines. These advantages are obtained while using reduced voltages on the scanning electrodes 33 and 34. The inventive structure, as shown by the examples above, also result in smaller spots on the screen and reduced color misconvergence.

What is claimed is:

1. In a flat panel display device having a baseplate and a phosphor screen supported on a faceplate, a plurality of internal support walls dividing said display device into a plurality of longitudinal channels, an electron beam guide assembly in each of said channels for propogating electrons longitudinally along said channels, each of said beam guide assemblies including an acceleration mesh for accelerating electrons toward said screen; said acceleration mesh including a plurality of columns of apertures extending longitudinally along said acceleration mesh; an improvement for converging electrons in the proximity of said screen and for transversely scanning electrons across said channels comprising:

a plurality of conductive strips arranged between and along both sides of each of said columns of apertures, said conduction strips being supported above said acceleration mesh, and between said acceleration mesh and said phosphor screen, the edges of said strips extending longitudinally along and substantially parallel to said acceleration mesh, the planes of said conductive strips extending substantially parallel to one another, and substantially normal to the plane of said acceleration mesh whereby electrons traveling toward said screen pass between said strips, a portion of said strips being voltage biased to converge electrons in the proximity of said screen and said strips being voltage biased to scan said electrons transversely across said channels.

2. The improvement of claim 1 wherein said strips are fixed to said acceleration mesh with an insulative adhesive.

3. The improvement of claim 1 wherein said strips are supported at the ends to retain said strips above said acceleration mesh.

4. The improvement of claim 1 wherein there are three of said columns of apertures and four of said conductive strips, the outer strips being biased to converge said electron beams and said four strips being biased to transversely scan said electron beams.

* * * * *